United States Patent [19]

Wellard

[11] 4,010,440

[45] Mar. 1, 1977

[54] ELECTRICAL RESISTOR COMPONENT ASSEMBLY WHICH IS HERMETICALLY SEALED

[75] Inventor: Charles L. Wellard, Cape May Court House, N.J.

[73] Assignee: American Components Inc., Conshohocken, Pa.

[22] Filed: Feb. 10, 1975

[21] Appl. No.: 548,668

[52] U.S. Cl. ..... 338/237; 29/613; 29/619; 338/274; 338/329

[51] Int. Cl.[2] ..... H01C 1/02

[58] Field of Search ..... 338/226, 233, 237, 264, 338/274, 322, 329, 332; 29/610, 613, 619, 621

[56] References Cited

UNITED STATES PATENTS

| | | | |
|---|---|---|---|
| 1,832,466 | 11/1931 | Means | 338/329 X |
| 2,660,653 | 11/1953 | Berkelhamer | 29/613 X |
| 3,037,266 | 6/1962 | Pfister | 29/613 |

*Primary Examiner*—C. L. Albritton
*Attorney, Agent, or Firm*—William E. Cleaver

[57] ABSTRACT

The present hermetically-sealed electrical resistor component assembly is composed of a sleeve of high-density, non-porous, non-hydroscopic material into which there is slip-fitted an electrical resistor component. Said electrical resistor component is sealed within said sleeve by a deposit of solder at each end of said sleeve whereat said solder clings to said sleeve, to the end cap of said resistor, and to the lead wire extending from said end cap. In some embodiments silicon rubber is employed as a gasket disposed along the end of said cap whereat it abuts said sleeve. In another embodiment, the entire package is encapsulated in a plastic material such as silicone-epoxy.

8 Claims, 2 Drawing Figures

ELECTRICAL RESISTOR COMPONENT ASSEMBLY WHICH IS HERMETICALLY SEALED

BACKGROUND

In many electronic circuit applications, it has been determined that the circuit components do not operate properly because of variations of humidity and temperature in the atmosphere which surrounds these circuit components. It is well understood that resistance values of resistors, capacitance values of capacitors, etc. in fact change in response to variations in temperature and humidity in the ambient air. It follows that these changes in circuit values of resistance and capacitance, etc. are highly undesirable since they lead to improper circuit performance.

Electronic components which are used in space vehicles, for instance, must be of a high precision nature and must not be infirmed by changes in values due to ambient temperature and humidity conditions. Accordingly, there are military specifications which set down the standards of humidity and temperature that such electronic components must meet in order that said components can be employed in circuitry used in space vehicles.

One attempt to isolate electronic components from the effects of temperature and humidity comprised encapsulating said electronic components in plastic material. For instance, it was hoped, early in the development of sealed components, that encapsulating components in an epoxy resin would serve to keep said components free from the effects of temperature and humidity changes. Unfortunately, it became apparent that the temperature coefficient of the epoxy usually differed from that of the component that it was surrounding and, accordingly, there resulted undesirable stresses on both the epoxy as well as the components as a result of changes in temperature. Secondly, it was often the case that moisture would creep through an epoxy encapsulation which was subjected to repeated cycles or conditions of high humidity.

In an effort to overcome the foregoing problems at least two major techniques have been attempted. First, it has been determined that moisture will not readily pass through a ceramic material. Glass and steatite are typical examples of ceramic materials which are non-porous. Accordingly, as part of one of the techniques found in the prior art, a hollow cylindrically-shaped ceramic substrate is employed and a thin film of metal is secured or deposited on the inside surface (i.e., the surface of the hollowed out section of the cylinder) to form an electrical resistance path. In other words, the thin film of metal conducts current but in so doing, acts as an electrical resistor. Such a resistor element, of course, is not a standard resistor inasmuch as a standard thin film electrical resistor normally has the film secured to the outside of the substrate. In addition, in the first technique, the hollowed out section is filled with an inert gas and end caps are secured over the cylinder ends. The end caps are formed so as to be in electrical connection with the metal film path which is disposed along the inside surface of said hollowed out portion of said cylinder. The sealed resistor of this first technique works reasonably well (when it is properly fabricated) even when subjected to variations of temperature and humidity. However, this last described resistor assembly is very costly and somewhat difficult to fabricate, since the deposition of the metal thin film on the inside of said hollowed out section and the spiralling thereof is a difficult and costly technique. In addition, this first technique (and its resultant resistor assembly) has severe limitations in that it does not lend itself to the production of a large number of different resistor sizes, and is limited in the field of miniaturized resistors since there is a lower practical limit on the size of a hollow cylinder which can have a spiral pattern of metal deposited therein.

In the second major technique, mentioned earlier, a standard resistor is located within a glass housing. Since the coefficient of temperature of the standard resistor normally would differ from the coefficient of temperature of the glass, a "bellows wire" (e.g., a loop wound, or a repeatedly crimped, wire which can expand when subjected to heat) is used to electrically connect the end of the standard resistor to the outside lead-in wire. This bellows wire acts as a support means to support one end of the standard resistor within the glass housing and also acts as an electrical connection to the "outside world." When there are changes of temperature, the bellows wire either expands or contracts depending upon the temperature condition and this enables the package to withstand temperature changes with a minimum amount of stress. However, the package is not a very ruggedized package and cannot withstand, for instance, great vibrations. In addition, it is also a costly matter to fabricate this last-mentioned package because of the "bellows wire" and because of the particular manner in which the lead-in wires must be secured to the glass housing.

SUMMARY

The present resistor assembly employs a non-porous, non-hydroscopic hollow cylinder, fabricated from high alumina, or glazed high quality porcelain, or steatite or the like. Into the hollow section of the cylinder there is located a standard type resistor; i.e., an electrical resistor comprising a ceramic substrate, a thin film of metal secured thereto which is usually spirally formed and end caps thereon with lead wires extending therefrom. This standard type resistor is preferably slip-fitted into the hollow cylinder although it is not necessary that the standard type resistor be in actual contact with the inside surface of the cylinder. If there is a sufficiently large gap between the end caps and the inside surface of said hollow cylinder, high temperature silicon rubber gaskets are employed (as will be more fully explained below) to aid in sealing the resistor within said hollow cylinder. In addition, high temperature solder is deposited between said end caps and said inside surface of said hollow cylinder while being drawn onto said lead wires. Thus a seal has been effected. Often the assembly is further encapsulated in epoxy silicon to protect it from physical damage.

The objects and features of the present invention will become more meaningful hereinafter in accordance with the teaching below taken in conjunction with the drawings in which.

Figure 1:
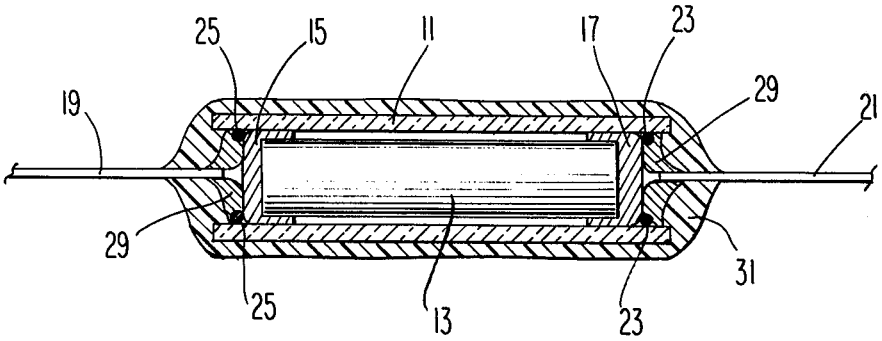
FIG. 1 shows the present resistor assembly, partially sectionalized.
Figure 2:
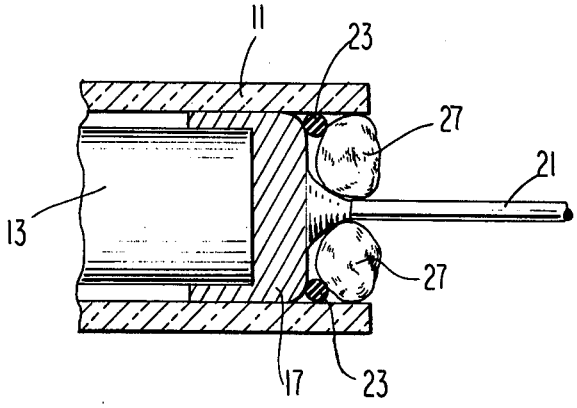
FIG. 2 depicts the end section of the resistor assembly before the solder balls are melted.

Consider the drawing in which there is depicted a sleeve, or hollow cylinder 11. The hollow cylinder 11 can be fabricated from high alumina, or glazed high quality porcelain, or steatite or rigid material provided said material is non-porous, non-hydroscopic and an electrical insulator. Located within the hollow cylinder 11 is a standard type electrical resistor 13. The standard type electrical resistor is composed of a ceramic substrate about which there is coated a thin film of metal usually formed in a spiral path although it is not shown that way for simplicity of the drawings. Over the ends of the thin film there are fitted end caps, such as end caps 15 and 17 (shown in section). The end caps 15 and 17 have lead wires 19 and 21 respectively secured thereto.

In the course of assembling the present resistor package, the standard type resistor 13 is preferably slip-fitted into the hollow cylinder 11; i.e., the caps 15 and 17 are in contact with inside surface of hollow cylinder 11 as it is positioned therewithin. If it should happen that the caps 15 and 17 lie away from said inside surface by no more than 3 mils, no extra elements are employed. On the other hand, if the gap between the caps 15 and 17 and the inside surface of hollow cylinder 11 exceeds 3 mils then high temperature silicon rubber gaskets 23 and 25 are employed. It should be noted that although the caps 15 and 17 are shown as being in contact with the inside surface, the rubber gaskets 23 and 25 are shown being employed and indeed they can be so employed although it has been determined that if the caps 15 and 17 are in contact with the inside surface or lying less than 3 mils therefrom, the rubber gaskets are not necessary.

After the standard type resistor 13 is located within the hollow cylinder 11 and the rubber gaskets 23 and 25 are located (if they are to be employed) solder balls 27, shown in dashed line, are located for melting purposes. The solder balls 27 are preferably high temperature solder balls.

Thereafter the resistor assembly is located in a furnace or heating chamber and the solderballs 27 are melted to (1) abut the inside surface of the hollow cylinder 11 and cling thereto, (2) abut said end caps 15 and 17 and cling thereto, and (3) creep up on said lead wires 19 and 21 and cling thereto. The melted and rehardened high temperature solder is shown in the drawing and is identified as 29. With the solder melted and rehardened as described above, the resistor package is now hermetically-sealed and will withstand the ill effects of varying temperature and humidity.

Be that as it may, the resistor assembly is vulnerable to physical damage which could break the seal. Accordingly, it is often the practice to encapsulate the entire package in epoxy silicon 31.

The present resistor package has the advantage of: being readily assembled with standard type resistors; being sealed against moisture and heat; and being ruggedized to withstand heavy vibrations.

I claim:

1. An hermetically sealed electrical resistor component assembly comprising in combination: A sleeve shaped member having first and second open ends and being fabricated from high-density, non-porous and non-hydroscopic material, said sleeve shaped member having an inside surface; an electrical resistor component including first and second end caps and first and second conducting wires respectively connected thereto, said electrical resistor component formed and disposed to have its first and second end caps fitting tightly against said inside surface of and within said sleeve shaped member with said first and second conducting wires respectively extending from said first and second open ends; and first and second solder means formed to respectively cling to said first and second end caps, to said inside surface of said sleeve shaped member and to said first and second conducting wires to thereby close, in sealed form, said first and second open ends of said sleeve shaped member with said electrical resistor component therebetween and further formed to permit said first and second conducting wires to respectively pass therethrough but in sealed contact therewith to protrude beyond the ends of said sleeve shaped member.

2. An hermetically sealed electrical resistor component assembly according to claim 1 wherein there is further included a plastic material formed to encapsulate said sleeve member and the sections of said first and second solder means lying away from said electrical resistor component and further formed to permit said first and second conducting wires to pass therethrough but in sealed contact therewith.

3. An hermetically sealed electrical resistor component assembly according to claim 1 wherein there is further included a first rubber gasket disposed to fit in contact with said first end cap and with said sleeve member along the region where said first end cap comes in close proximity to said sleeve member toward said first open end to form a gasket seal between said first end cap and said sleeve member therealong.

4. An hermetically sealed electrical resistor component assembly according to claim 1 wherein there is further included a second rubber gasket disposed to fit in contact with said second end cap and with said sleeve member along the region where said second end cap comes in close proximity to said sleeve member toward said second open end to form a gasket seal between said first end cap and said sleeve member therealong.

5. An hermetically sealed electrical resistor component assembly according to claim 1 wherein said sleeve member is fabricated from high alumina.

6. An hermetically sealed electrical resistor component assembly according to claim 1 wherein said sleeve member is fabricated from glazed high quality porcelain.

7. An hermetically sealed electrical resistor component assembly according to claim 1 wherein said sleeve member is fabricated from steatite.

8. An hermetically sealed electrical resistor component assembly according to claim 1 wherein said electrical resistor component is slip-fitted into said sleeve member.

* * * * *